US006523332B1

(12) United States Patent
Erb

(10) Patent No.: US 6,523,332 B1
(45) Date of Patent: Feb. 25, 2003

(54) SELF ADJUSTING SADDLE TREE

(76) Inventor: Alexa Erb, 638 Hoffman St., Muskegon, MI (US) 49442

( * ) Notice: Subject to any disclaimer, the term of this patent is extended or adjusted under 35 U.S.C. 154(b) by 0 days.

(21) Appl. No.: 10/100,417

(22) Filed: Mar. 18, 2002

(51) Int. Cl.[7] ..... B68C 1/02
(52) U.S. Cl. ..... 54/44.5; 54/44.1
(58) Field of Search ..... 54/37.1, 38.1, 54/44.1, 44.5, 46.1

(56) References Cited

U.S. PATENT DOCUMENTS

| | | | | | |
|---|---|---|---|---|---|
| 481,945 | A | * | 9/1892 | Hart | 54/44.1 |
| 1,462,885 | A | * | 7/1923 | Hawkins | 54/46.1 |
| 2,302,947 | A | * | 11/1942 | Kohler | 54/1 |
| 3,835,621 | A | | 9/1974 | Gorenschek | |
| 4,265,075 | A | | 5/1981 | Motsenbocker | |
| 4,324,090 | A | | 4/1982 | Nix | |
| 4,745,734 | A | | 5/1988 | Brown | |
| 4,965,988 | A | | 10/1990 | Anderson | |
| 4,996,827 | A | | 3/1991 | Pellew | |
| 5,191,752 | A | | 3/1993 | Murphy | 54/44.5 |
| 5,195,306 | A | | 3/1993 | Hadlock | 54/44.7 |
| 5,274,986 | A | * | 1/1994 | Gonzales | 54/44.1 |
| 5,343,674 | A | | 9/1994 | Brown | 54/44.1 |
| 5,383,328 | A | | 1/1995 | Brown | 54/44.3 |
| 6,263,647 | B1 | | 7/2001 | Walkley | 54/44.1 |

FOREIGN PATENT DOCUMENTS

| | | | | |
|---|---|---|---|---|
| EP | 0720586 A1 | | 7/1996 | |
| FR | 2669914 A1 | * | 6/1992 | B68C/1/02 |
| WO | WO 9950174 A1 | | 10/1999 | |

* cited by examiner

*Primary Examiner*—Robert P. Swiatek
(74) *Attorney, Agent, or Firm*—King & Jovanovic, PLC

(57) ABSTRACT

A saddle tree comprising a first and a second side bar, a center bar, and a base. The first and second side bars each include a proximal and a distal end. The center bar is associated with each of the first and second side bars toward the proximal ends thereof. The base is associated with each of the first and second side bars at a second end and the center bar at a first end. The center bar is structurally configured to provide both torsional and longitudinal flexibility, to, in turn, permit the first and second side bars to move independently of each other.

18 Claims, 7 Drawing Sheets

SELF ADJUSTING SADDLE TREE

BACKGROUND OF THE INVENTION

1. Field of the Invention

The present invention relates in general to an equine saddle, and more particularly, to a self adjusting saddle tree which facilitates the adaptation thereof for a variety of horses' shoulders and/or backs. Such a saddle tree is capable of flexing with the movement of a horse to preclude interference with the shoulders and the back of the horse during the movement thereof.

2. Background Art

Equine saddles and, therefore, saddle trees have been known in the art for several years. A saddle tree may comprise a variety of materials including wood, fiberglass, rawhide, and/or combinations of these materials. For heavy duty use, such as cattle roping and the like, a saddle with a rawhide-covered tree remains the preferred material. However, modem saddle trees generally comprise fiberglass or fiberglass-covered wood.

Conventional equine saddles typically comprise leather pieces positioned upon a saddle tree. A conventional saddle tree typically comprises a base, a fork, a horn, and a cantle.

The base may include a pair of long, relatively narrow bar elements, each having a proximal and a distal end. The bar elements are generally positioned to extend longitudinally along the back of the horse from front to back, along either side of the spine.

The fork member is typically associated with the proximal ends of the bar elements, typically via fasteners such as nails, screws, bolts, and the like.

In conventional saddles, the horn is associated with the middle of the fork. Depending on the particular embodiment, the horn may comprise a separate element which is attached to the fork by nails, screws, bolts, and the like, or, alternatively, it may be integral with the fork.

The cantle is generally associated with the bar elements proximate the distal ends thereof. Similar to the horn, the cantle may be attached to the bar elements through fasteners such as nails, screws, bolts, and the like. The cantle generally forms the back of the saddle tree to, in turn, essentially preclude the rider from slipping off the rear of the saddle.

To complete a saddle, the foregoing saddle tree components are covered with leather, or any comparable material, and additional components, such as a seat cover, ornamentation, cinch straps, and the like may be included.

While the foregoing conventional saddle tree has been utilized for many years, its widespread use remains, to this day, problematic for a plurality of reasons. In particular, the conventional saddle tree is rigid, and, therefore, not readily adjustable to properly fit the dimensions of a horse. Moreover, due to its rigidity, it is not able to compensate for changes to the back of a horse during the movement of the horse. Furthermore, conventional saddles do not have an ability to readily adjust relative to changes which may occur over the lifetime of a horse (i.e., weight gain, weight loss, etcetera).

Moreover, the foregoing conventional saddle tree typically places the weight of the user on relatively small portions of the horse's back. In particular, such a saddle tree forms a bridge across a horse's back between the withers and scalpula, toward the front of the horse, and the loins, toward the rear of the horse. In turn, the weight of the saddle and rider rests primarily on four small points, and is not evenly distributed over the horse's back. As the horse moves, the rider and saddle shift back and forth, changing the pressure points on the horse's back. Placement of the weight of the rider and saddle on four small points bridged by a rigid saddle tree can restrict the horse's freedom of movement, and can cause excessive friction and/or stress at these points as the horse's skin stretches and shrinks due to its changing body shape during movement. Such friction and/or stress may result in sores developing on the body of the horse proximate the four points, leading to irritation and, ultimately, an unridable horse.

While several advances in the field have developed which have provided the employment of new materials such as reinforced rubber material for the bar elements, offering more flexibility, the bar elements still remain rather hard and unforgiving when placed onto the back of a horse. Moreover, the fork of these saddles remains fixed and unadjustable to different shoulder widths. As a result, these improvements have only marginally improved the overall saddle design.

Accordingly, it is an object of the present invention to provide a saddle which conforms to the contours of the horse.

It is another object of the present invention to provide a saddle tree which is capable of substantially accurate adjustment.

It is yet another object of the present invention to improve the freedom of movement of the horse.

Furthermore, it is another object of the present invention to improve the distribution of weight of the rider.

These and other objects will become apparent in light of the specification, drawings, and claims appended hereto.

SUMMARY OF THE INVENTION

The present invention is directed to a saddle tree comprising: (a) a first and a second side bar, each having a proximal and a distal end; (b) a center bar associated with each of the first and second side bars toward the proximal ends thereof, the center bar structurally configured to provide torsional flexibility, to, in turn, permit the first and second side bars to move independently of each other; and (c) a base associated with each of the first and second side bars at a second end and the center bar at a first end.

In a preferred embodiment of the present invention, the first and second side bars are structurally configured to provide longitudinal flexibility.

In another preferred embodiment of the present invention, the saddle tree further comprises a padding assembly, the padding assembly including a first pad operatively associated with the first side bar and a second pad operatively associated with the second side bar. In this embodiment, the padding assembly preferably comprises a closed cell foam material, and preferably includes a tapered cross-sectional configuration.

In yet another preferred embodiment of the present invention, the base is attached to each of the center bar and the first and second side bars.

The present invention is also directed to a saddle tree comprising: (a) a first and a second side bar, each having a proximal and a distal end, the first and second side bars structurally configured to longitudinally flex upon the application of weight thereto, to, in turn, facilitate the distribution of weight therealong; (b) a center bar associated with each of the first and second side bars toward the proximal ends thereof; and (c) a base associated with each of the first and second side bars at a second end and the center bar at a first end.

In a preferred embodiment of the present invention, the saddle tree further comprises a padding assembly associated with each of the first and second side bars. In this embodiment, the padding assembly preferably comprises a first pad and a second pad, the first pad being associated with the first side bar and the second pad being associated with the second side bar. The first and second pads preferably include a tapered cross-section, and preferably comprise a closed cell foam material.

In another preferred embodiment of the present invention, (a) the center bar includes a central region, a first extension, and a second extension; (b) the base is attached at the first end to the central region of the center bar and at the second end to the distal end of each of the first and second side bars; and (c) the center bar is attached to respective side bars proximate the first extension and second extension thereof.

The present invention is also directed to a saddle tree comprising: (a) a first and a second side bar, each having a proximal and a distal end; (b) a center bar associated with each of the first and second side bars toward the proximal ends thereof, the center bar structurally configured to provide longitudinal flexibility, to, in turn, bow and permit the adjustment of the spacing of the first and second side bars to accommodate the configuration of the horse; and (c) a base associated with each of the first and second side bars at a second end and the center bar at a first end.

Furthermore, the present invention is directed to a saddle comprising: (a) a saddle tree comprising: (1) a first and a second side bar, each having a proximal and a distal end; (2) a center bar associated with each of the first and second side bars toward the proximal ends thereof, the center bar structurally configured to provide both torsional and longitudinal flexibility, to, in turn, permit the first and second side bars to move independently of each other; (3) a base associated with each of the first and second side bars at a second end and the center bar at a first end; (4) a first pad associated with the first side bar; and (5) a second pad associated with the second side bar; and (b) a cover configured to overlayingly engage the first and second side bars and the center bar.

In a preferred embodiment of the present invention, the saddle further comprises a seat associated with the base.

In another preferred embodiment of the present invention, the saddle further comprises a pommel associated with each of the first and second side bars.

In yet another preferred embodiment of the present invention, the saddle further comprises a stirrup assembly associated with each of the first and second side bars.

Preferably, the saddle further comprises a billet strap associated with each of the first and second side bars.

In another preferred embodiment of the present invention, the cover is configured into one of an English, Western, or Australian style.

BRIEF DESCRIPTION OF THE DRAWINGS

The invention will now be described with reference to the drawings wherein.

DETAILED DESCRIPTION OF THE INVENTION

Figure 1:
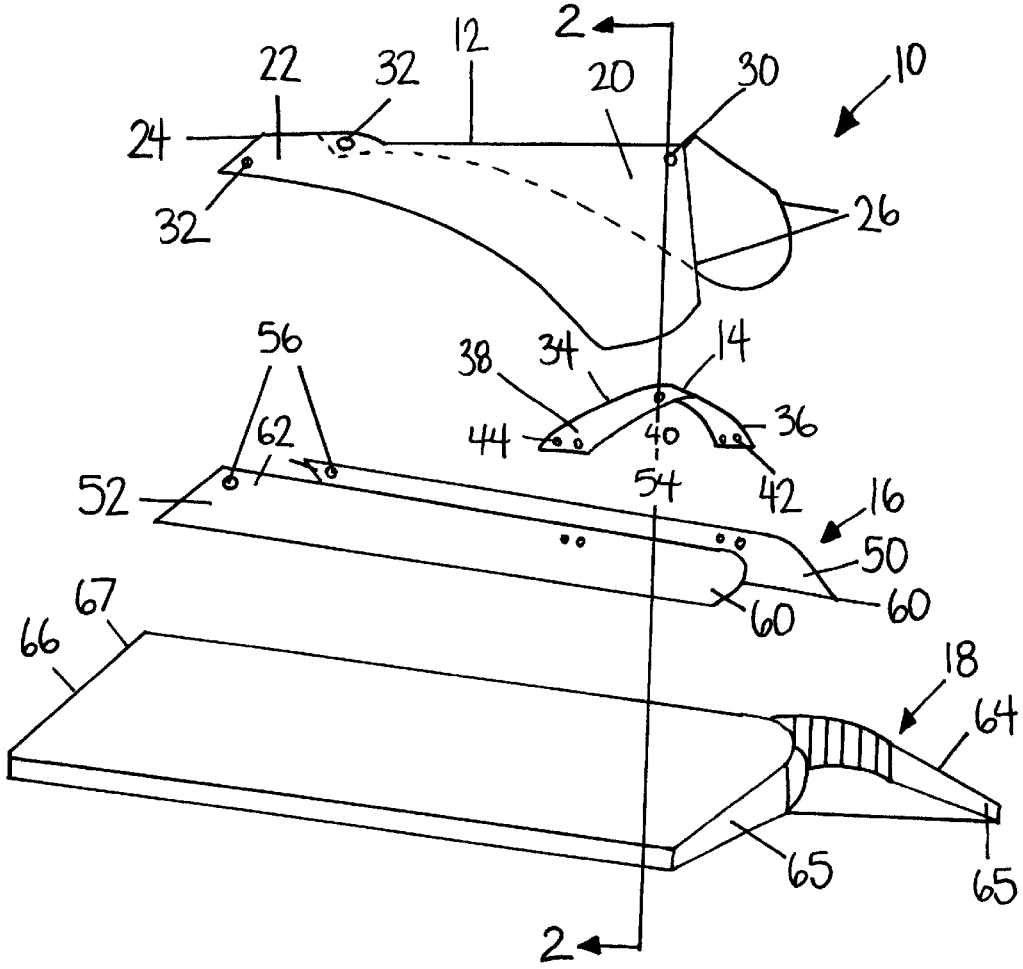
FIG. 1 of the drawings is an exploded perspective view of an embodiment of a saddle tree in accordance with the present invention.
Figure 2:
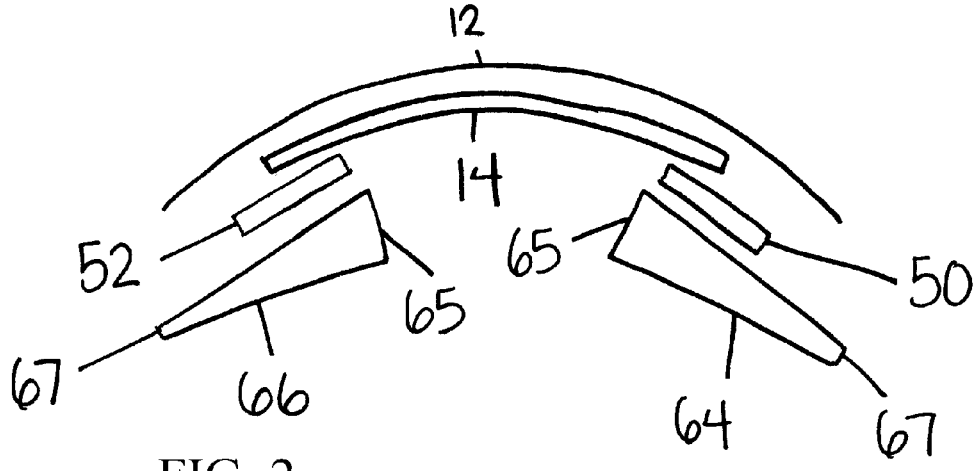
FIG. 2 of the drawings is a cross sectional view of the saddle tree of FIG. 1, taken generally about lines 2—2 of FIG. 1.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, are identified throughout the drawing by like reference characters. In addition, it will be understood that the drawing is merely a representation, and some of the components may have been distorted from actual scale for purposes of pictorial clarity.

Referring now to the Figures, and in particular to FIG. 1, saddle tree assembly 10 is shown as generally comprising base 12, center bar 14, side bar assembly 16, and padding assembly 18. As will be explained in detail below, the saddle tree can be used in association with further assemblies for a saddle. The saddle tree of the present invention generally provides a foundation for a saddle.

Base 12 is shown in FIG. 1 as comprising first end 20, second end 22, longitudinal axis 24 and overhanging flanges 26. First end 20 includes center bar attachment region 30. Second end 22 includes side bar attachment region 32. The overhanging flanges 26 extend away from longitudinal axis 24 proximate first end 20 of base 12. The particular shape of base 12 is not crucial, and a variety of different shapes are contemplated for use. In addition, base 12 generally comprises a leather material, while it is likewise contemplated that the base may comprise a variety of natural and synthetic materials.

Center bar 14 is shown in FIG. 1 as comprising central region 34, first extension 36 and second extension 38. The first and second extensions extend substantially uniformly away from central region 34. In addition, central region 34 includes central attachment region 40. First extension 36 includes side bar attachment region 42. Second extension 38 includes side bar attachment region 44. Dimensionally, the center bar of the present embodiment preferably comprises a length of approximately 5 to approximately 15 inches and, preferably, a width of approximately 0.5 to approximately 3 inches, however, a variety of lengths and widths are contemplated to suit a variety of saddles. As will be explained, center bar 14 is capable of bowing and twisting elastically without substantial deformation. As such, center bar 14 generally comprises a flexible material, including but not limited to plastics, fiberglass, rubber, natural or synthetic resins, or combinations thereof.

Side bar assembly 16 is shown in FIG. 1 as comprising first side bar 50 and second side bar 52. Each of the side bars include proximal end 60 and distal end 62. Center bar attachment region 54 is associated with proximal end 60 of each of the side bars. Base attachment region 56 is associated with distal end 62. The side bar assemblies comprise a flexible material, including but not limited to plastics, fiberglass, rubber, natural or synthetic resins, or combinations thereof.

Figure 3A:
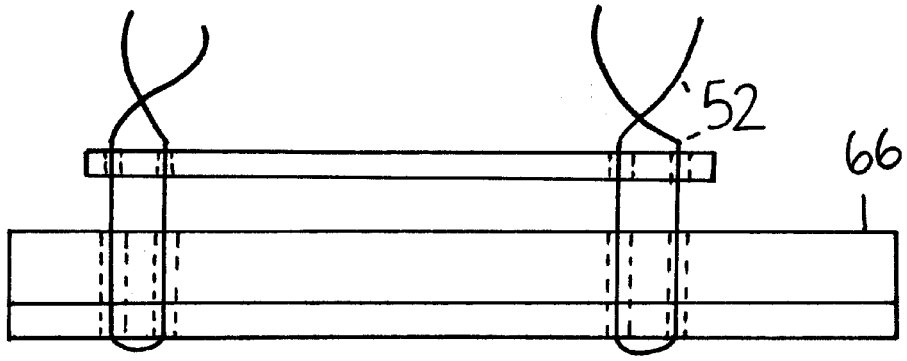
FIG. 3A of the drawings is a side view of a saddle tree in accordance with the present invention, showing, in particular, an attachment of a pad to a side bar.
Figure 3B:
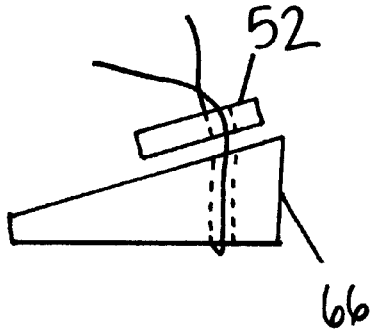
FIG. 3B of the drawings is a front view of a saddle tree in accordance with the present invention, showing, in particular, an attachment of a pad to a side bar.
Figure 4:
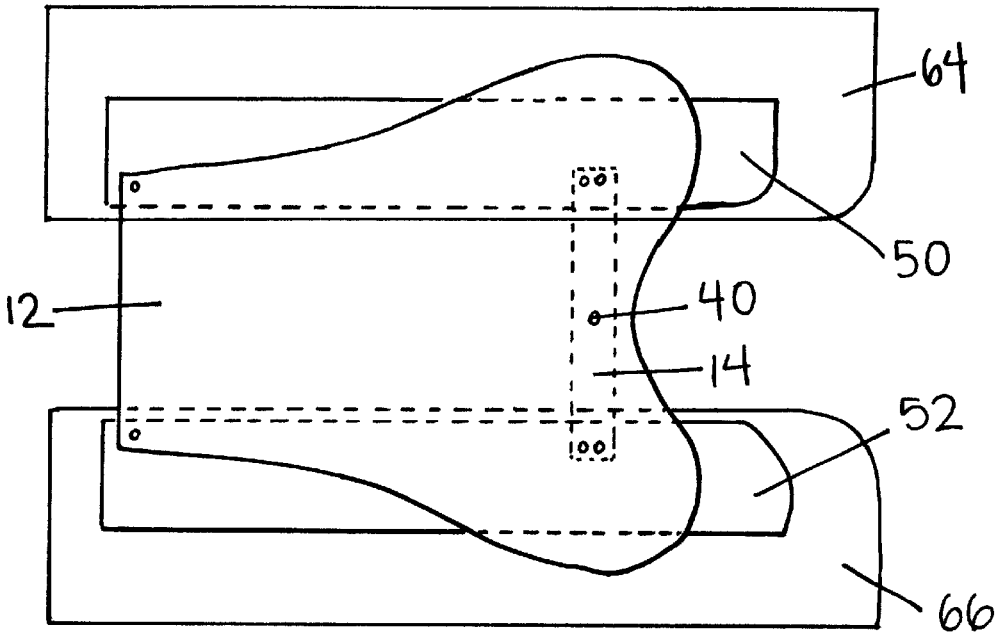
FIG. 4 of the drawings is a top plan view of a saddle tree in accordance with the present invention.

Padding assembly 18 is shown in FIG. 1 as comprising first pad 64 and second pad 66. The first and second pads extend from proximal end 65 to distal end 67. The pads generally include a varying cross-section, one which is thickest proximate the spine of the horse, and which tapers as it extends from the spine of the horse. Such a tapered construction is also shown in FIG. 3B. It is likewise contemplated that padding assembly 18 can be integrated into a single pad capable of interfacing with each of the separate side bars. Padding assembly 18 generally comprises a closed cell foam which rebounds to its initial shape quickly upon release of pressure. Of course other materials are likewise contemplated for use.

To assemble the saddle tree assembly, first and second side bars 50, 52 are provided. Next, center bar 14 is provided. The center bar is attached to each of the side bars. In particular, first side bar attachment region 42 is attached to center bar attachment region 54 of first side bar 50. Next, second side bar attachment region 44 is attached to center bar attachment region 54 of second side bar 52. Preferably, the center bar is positioned slightly away from proximal end 60 of the side bars to enhance the ability to move independently and to respond to the movements of the horse. These regions can be attached by way of bolts, nails, rivets laces, hook and loop fasteners, and other attachment assemblies.

Once the side bars are attached to the center bar, the base can be positioned and attached. In particular, center bar attachment region 30 of first end 20 of base 12 is attached to central attachment region 40 of center bar 14. In a similar fashion, side bar attachment region 32 of second end 22 of base 12 can be attached to the respective base attachment regions 56 of each side bar 50, 52. These attachments can likewise be accomplished by way of bolts, nails, rivets, laces, hook and loop fasteners, and other attachment assemblies.

Next, padding assembly 18 is attached to side bar assembly 16. In particular, first pad 64 is attached to first side bar 50, and second pad 66 is attached to second side bar 52. As is shown in FIGS. 3A and 3B, the pads may be attached to the respective side bars by way of laces made from leather or other natural and/or synthetic materials. Of course, various other means of attachment are contemplated including, bolts, hook and loop fasteners, snaps, buttons, etc.

It is contemplated that the materials selected and described above can render a lightweight saddle tree which weighs less than 10 lbs. Of course, the invention is not limited to a saddle tree having any particular configuration, material, and/or weight.

Figure 6:
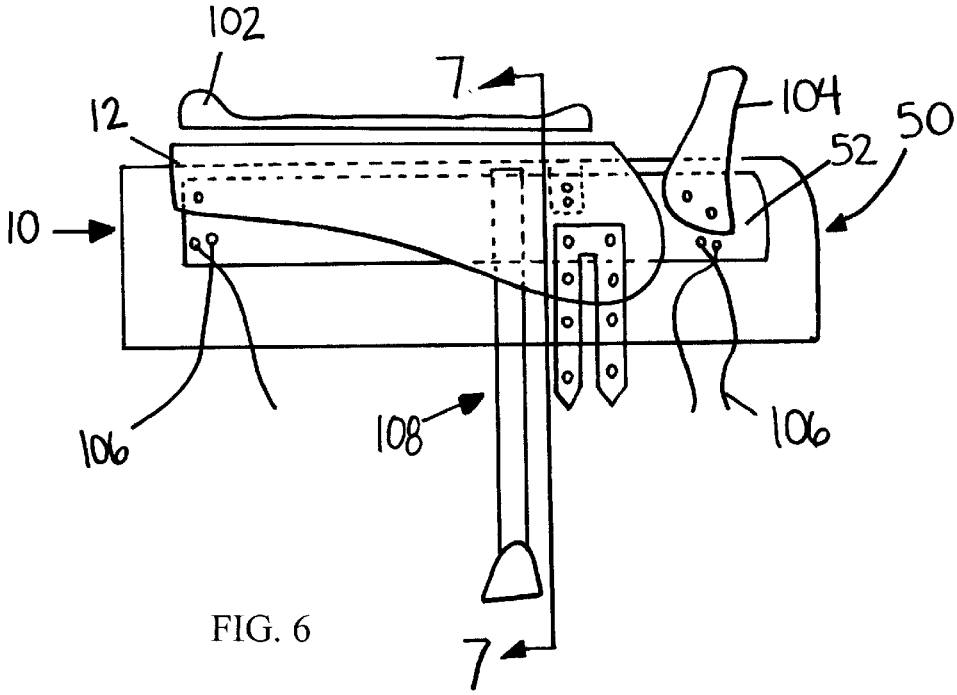
FIG. 6 of the drawings is a side view of an embodiment of a saddle tree in accordance with the present invention, showing, in particular, additional features, such as a pommel, a cushioned seat, a girthing system, and a stirrup assembly.
Figure 7:
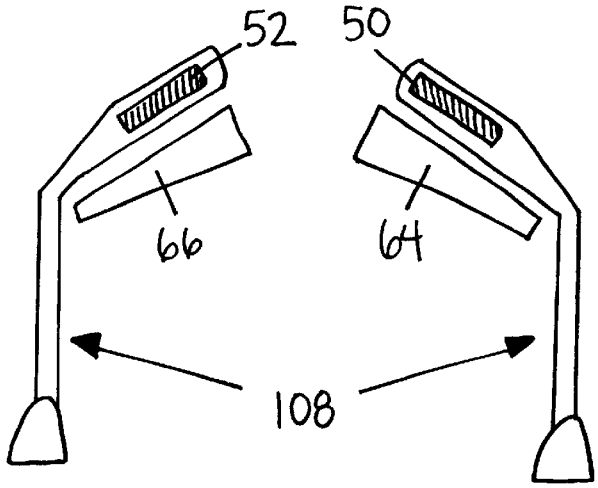
FIG. 7 of the drawings is a cross sectional view of the embodiment of FIG. 6, taken generally about lines 7—7 of FIG. 6, showing, in particular, slidable receipt thereof by two side bars.

Once the saddle tree assembly 10 is completed, additional components can be associated therewith to complete a saddle. In particular, as is shown in FIG. 6, seat 102 can be positioned on base 12. The seat may be cushioned with various synthetic and/or natural materials, including foam padding, to provide additional comfort to the user.

In addition, as is shown in FIG. 6, pommel 104 can be associated with each of the first and second side bars 50, 52 of side bar assembly 16. The pommel may comprise a resilient yet flexible material, such as leather, rubber, or the like.

Figure 9:
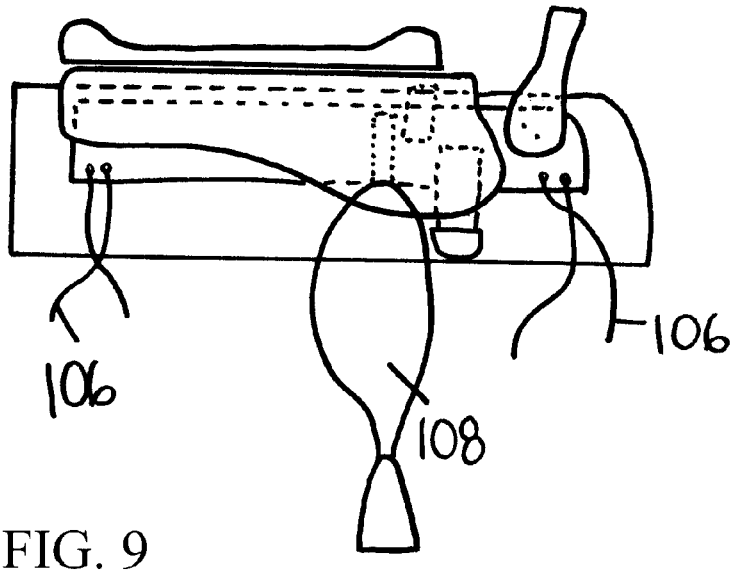
FIG. 9 of the drawings is a side view of a Western girth rigging, showing, in particular, the similarity between the receipt of a Western style stirrup assembly with that of an English style.

Additionally, as is shown in FIGS. 6 and 9, billet straps 106 and stirrup assemblies 108 can be looped or otherwise attached to each side bar at corresponding and opposing positions. Specifically, FIG. 6 depicts an English stirrup and rigging assembly, and FIG. 9 depicts a western stirrup and rigging assembly. Of course, the stirrup and rigging assemblies are not limited to these particular styles.

Figure 8A:
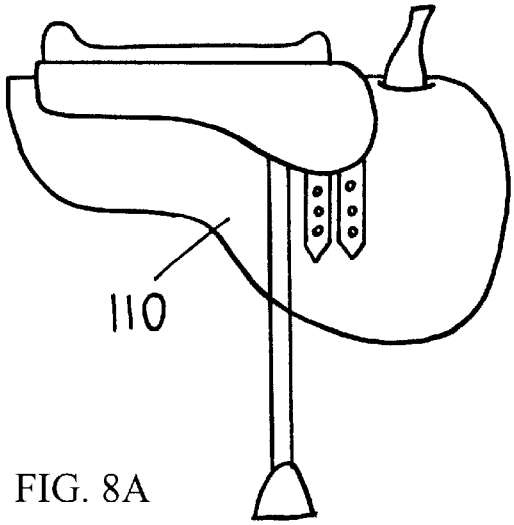
FIG. 8A of the drawings is a side view of an English style embodiment in accordance with the present invention.
Figure 8B:
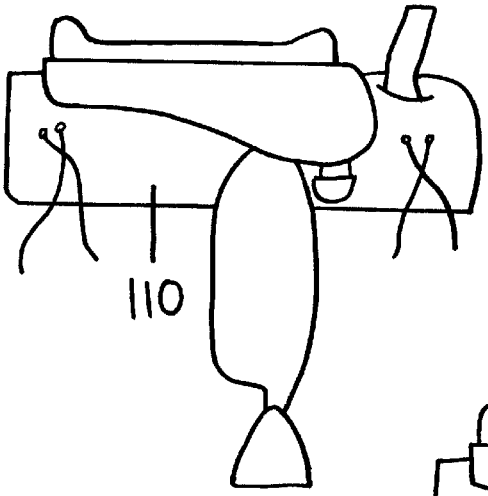
FIG. 8B of the drawings is a side view of a Western style embodiment in accordance with the present invention.
Figure 8C:
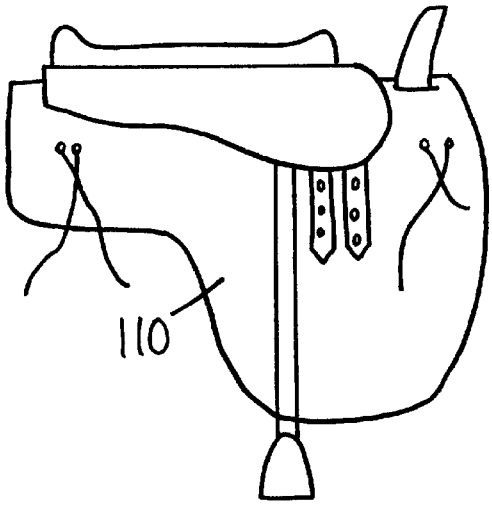
FIG. 8C of the drawings is a side view of an Australian stock style embodiment in accordance with the present invention.

Finally, the respective side bars 50, 52 and the respective pads 64, 66 can be decoratively covered by cover 110. Cover 110 comprises a variety of materials, such as leather or other natural and/or synthetic materials. Certain shapes of the cover are shown in FIGS. 8A (English), 8B (Western), and 8C (Australian), while it will be understood that the cover is not limited to any such shapes.

Figure 10:
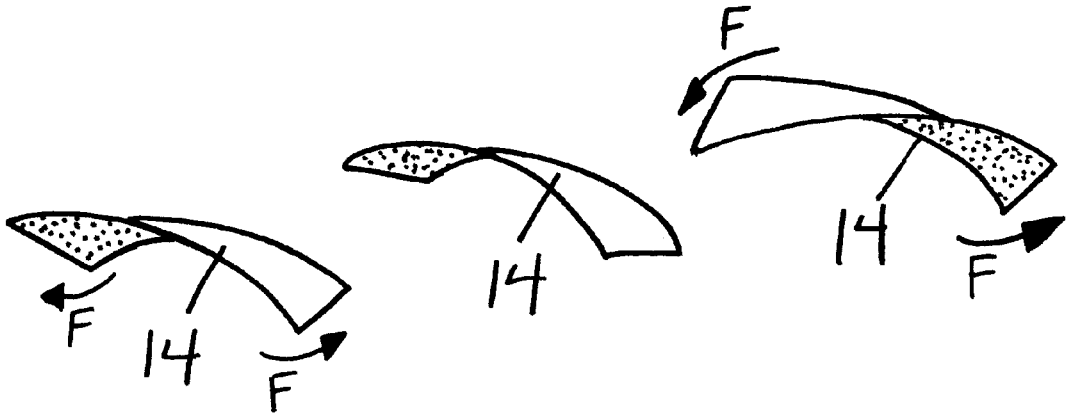
FIG. 10 of the drawings is a sequential perspective view of rotational flexibility of a center bar showing varying rates of torsion, in accordance with the present invention.
Figure 11:
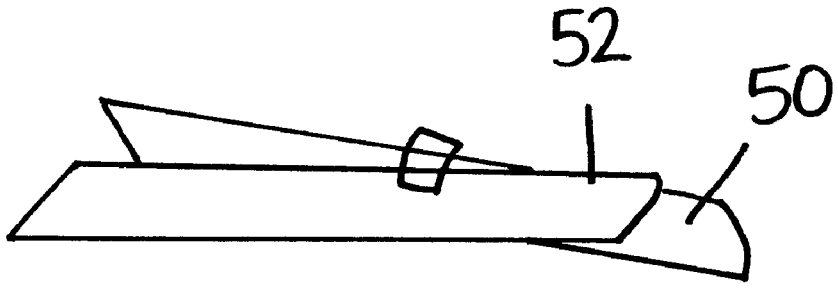
FIG. 11 of the drawings is a perspective view of two sidebars and a center bar, showing, in particular, independent rotation of the sidebars.
Figure 12:
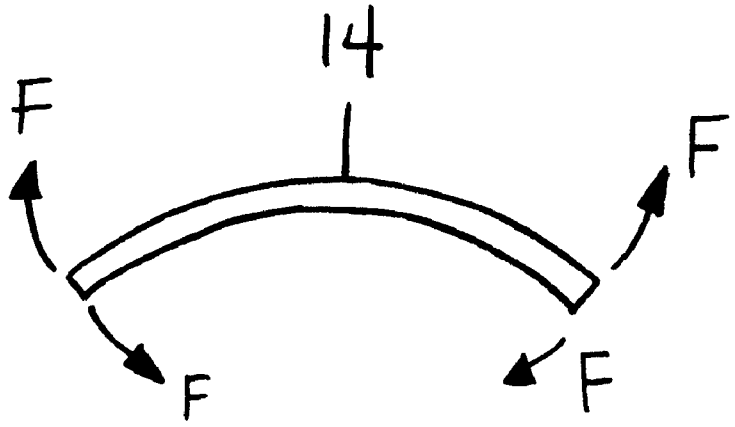
FIG. 12 of the drawings is a front view of a center bar in operation, showing, in particular, flexibility of same.

In operation, a saddle tree assembly (or appropriate saddle made therefrom) is placed on the back of the horse. Once positioned on the horse, center bar 14 maintains the proximal ends of the first and second side bars. As is shown in FIGS. 10 and 12, the center bar is substantially flexible in that it is capable of both torsional flexibility and longitudinal (or bowing) flexibility. As is shown in FIG. 11, the torsional flexibility allows the side bars to move relative to each other to automatically adjust to the back of the horse, as the horse is moving. Similarly, the ability to longitudinally bow facilitates the automatic adjustment of the saddle tree to accommodate different horses having different sizes and shapes.

Figure 5:
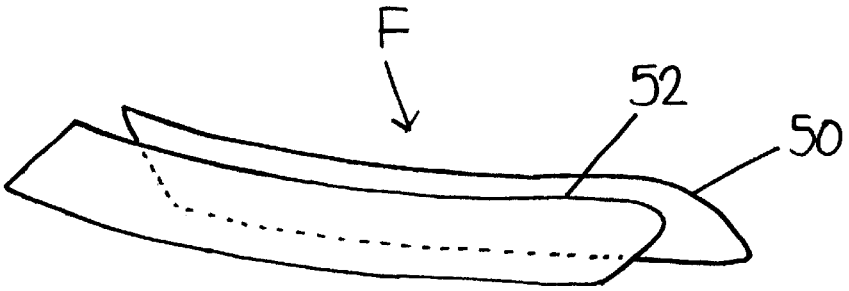
FIG. 5 of the drawings is a perspective view of two sidebars in an operative position, showing, in part, bowing thereof due to the force from a rider's weight.

Moreover, inasmuch as the side bars comprise a resilient yet flexible material, the side bars bow under the weight of a rider, as is shown in FIG. 5, thereby enhancing the dispersion of weight along the length of side bars 50, 52 and padding assembly 18. Inasmuch as the pads are thickest proximate the spine of the horse, regardless of the position of the rider, the spine of the horse remains protected and free from undesired contact.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A saddle tree, comprising:

a first and a second side bar, each having a proximal and a distal end;

a center bar including a central region, a first extension, and a second extension, the center bar is attached to respective side bars proximate the first extension and the second extension thereof and toward the proximal ends of the first and second side bars, the center bar structurally configured to provide torsional flexibility, to, in turn, permit the first and second side bars to move independently of each other; and a base attached at the first end to the central region of the center bar and at the second end to the distal end of each of the first and second side bars.

2. The saddle tree in accordance with claim 1, wherein the first and second side bars are structurally configured to provide longitudinal flexibility.

3. The saddle tree in accordance with claim 1, further comprising a padding assembly, the padding assembly including a first pad operatively associated with the first side bar and a second pad operatively associated with the second side bar.

4. The saddle tree in accordance with claim 3, wherein the padding assembly comprises a closed cell foam material.

5. The saddle tree in accordance with claim 3, wherein the padding assembly includes a tapered cross-sectional configuration.

6. The saddle tree in accordance with claim 1, wherein the base is attached to each of the center bar and the first and second side bars.

7. A saddle tree, comprising:

a first and a second side bar, each having a proximal and a distal end, the first and second side bars structurally configured to longitudinally flex upon the application of weight thereto, to, in turn, facilitate the distribution of weight therealong;

a center bar including a central region, a first extension, and a second extension is attached to respective side bars proximate the first extension and the second extension thereof toward the proximal ends of the first and second side bars; and a base is attached at the first end to the central region of the center bar and at the second end to the distal end of each of the first and second side bars.

8. The saddle tree in accordance with claim 7, further comprising a padding assembly associated with each of the first and second side bars.

9. The saddle tree in accordance with claim 8, wherein the padding assembly comprises a first pad and a second pad, the first pad being associated with the first side bar and the second pad being associated with the second side bar.

10. The saddle tree in accordance with claim 9, wherein each of the first and second pads include a tapered cross-section.

11. The saddle tree in accordance with claim 9, wherein the first and second pads comprise a closed cell foam material.

12. A saddle tree, comprising:

a first and a second side bar, each having a proximal and a distal end;

a center bar including a central region, a first extension, and a second extension, the center bar is attached to respective side bars proximate the first extension and the second extension thereof and is associated with each of the first and second side bars toward the proximal ends thereof, the center bar structurally configured to provide longitudinal flexibility, to, in turn, bow and permit the adjustment of the spacing of the first and second side bars to accommodate the configuration of the horse; and a base is attached at the first end to the central region of the center bar and at the second end to the distal end of each of the first and second side bars.

13. A saddle, comprising:

a saddle tree comprising:

a first and a second side bar, each having a proximal and a distal end;

a center bar including a central region, a first extension, and a second extension, the center bar is attached to respective side bars proximate the first extension and the second extension thereof and toward the proximal ends of the first and second side bars, the center bar structurally configured to provide both torsional and longitudinal flexibility, to, in turn, permit the first and second side bars to move independently of each other;

a base attached at the first end to the central region of the center bar and at the second end to the distal end of each of the first and second side bars;

a first pad associated with the first side bar; and a second pad associated with the second side bar; and a cover configured to overlayingly engage the first and second side bars and the center bar.

14. The saddle in accordance with claim 13, further comprising a seat associated with the base.

15. The saddle in accordance with claim 13, further comprising a pommel associated with each of the first and second side bars.

16. The saddle in accordance with claim 13, further comprising a stirrup assembly associated with each of the first and second side bars.

17. The saddle in accordance with claim 13, further comprising a billet strap associated with each of the first and second side bars.

18. The saddle in accordance with claim 13, wherein the cover is configured into one of an English, Western, or Australian style.

* * * * *